United States Patent [19]

Bishop et al.

[11] Patent Number: 4,783,281

[45] Date of Patent: Nov. 8, 1988

[54] DETERGENT POWDER AND PROCESS FOR ITS PREPARATION

[75] Inventors: David P. Bishop; Peter J. Russell; Peter C. Knight, all of Merseyside, United Kingdom

[73] Assignee: Lever Brothers Company, New York, N.Y.

[21] Appl. No.: 816,930

[22] Filed: Jan. 8, 1986

[30] Foreign Application Priority Data

Jan. 28, 1985 [GB] United Kingdom ..... 8502032

[51] Int. Cl.[4] ..... C11D 7/12; C11D 7/14

[52] U.S. Cl. ..... 252/135; 252/174.14; 252/530; 252/534; 252/537

[58] Field of Search ..... 252/135, 140, 537, 530, 252/539, 174.14, 534

[56] References Cited

U.S. PATENT DOCUMENTS 4,075,117 2/1978 Morton et al. ..... 252/135
4,299,716 11/1981 Cottrell et al. ..... 252/174.14

FOREIGN PATENT DOCUMENTS 912396 11/1972 Canada .
1070210 1/1980 Canada .
0141472 5/1985 European Pat. Off. .
0141470 5/1985 European Pat. Off. .
1412401 11/1975 United Kingdom .
2060677 5/1981 United Kingdom .
2063289 6/1981 United Kingdom .
2106482 4/1983 United Kingdom .
2109398 6/1983 United Kingdom .

*Primary Examiner*—Paul Lieberman
*Assistant Examiner*—Hoa Van Le
*Attorney, Agent, or Firm*—Gerard J. McGowan, Jr.; James J. Farrell

[57] ABSTRACT

A spray-dried detergent powder contains from 15 to 40% by weight of anionic surfactant, from 20 to 70% by weight of sodium carbonate, from 5 to 20% by weight of sodium silicate and from 1 to 7.5% by weight of sodium bicarbonate, the weight ratio of sodium bicarbonate to sodium silicate being within the range of from 0.20:1 to 0.45:1. Optionally further sodium bicarbonate (up to 15% by weight) is postdosed to the spray-dried powder. The benefits of the invention are improved powder properties and, when further sodium bicarbonate is postdosed, mildness to hands.

10 Claims, No Drawings

DETERGENT POWDER AND PROCESS FOR ITS PREPARATION

This invention relates to detergent powders and to a process for preparing them by spray-drying. In particular it relates to detergent powders containing relatively high levels of anionic surfactants together with carbonate species as detergency builders. Such powders are suitable for use in hand washing of fabrics or in machines of the top loading type, since they develop high levels of foam which makes them inappropriate for use in horizontal drum washing machines.

In choosing a formulation for a powder intended for hand washing there are a large number of factors. To be certain of achieving an adequate suds level in use sufficient detergency builder must be present to avoid the surfactant being precipitated by calcium and magnesium ions present in the wash water. Against that the alkalinity of the product must be controlled to avoid harshness to hands. Furthermore, and assuming that the powder is to be prepared by a slurry-making and spray-drying process, a formulation must be chosen to avoid any tendency for the slurry to develop unacceptable viscosity or to gel, and the resulting spray-dried powders must be of adequate mechanical strength.

We have found that the above criteria can be met by incorporating in a spray-dried carbonate-built powder a defined amount of sodium bicarbonate, of which a certain proportion is incorporated in the slurry before spray-drying, and the remainder subsequently postdosed to the spray-dried powder. The total amount of sodium bicarbonate present in the final powder is less than the amount of sodium carbonate present.

Detergent powders containing anionic surfactants together with sodium carbonate and lesser amounts of sodium bicarbonate are disclosed in CA No. 912 396 (Witco) and CA No. 1 070 210 (Church & Dwight), but these are not spray-dried. CA No. 1 070 210 (Church & Dwight) is concerned only with dry-mixing processes. CA No. 912 396 (Witco) discloses both spray-drying and mixing methods for making powders containing sodium carbonate and optional sodium bicarbonate or sesquicarbonate, but recommends that these latter compounds be included only when non-spray-drying procedures are used. GB No. 2 060 677B (Unilever) discloses the postdosing of sodium bicarbonate (1–20% by weight) to powders built with sodium carbonate and sodium orthophosphate.

The present invention provides a spray-dried detergent powder formulated to comprise:

(a) from 15 to 40% by weight, preferably from 20 to 40% by weight, of anionic surfactant;
(b) from 20 to 70% by weight, preferably from 25 to 60% by weight, of sodium carbonate;
(c) from 5 to 20% by weight of sodium silicate; and
(d) from 1 to 22.5% by weight of sodium bicarbonate in total, of which from 1 to 7.5% by weight is incorporated before spray-drying and from 0 to 15% by weight admixed after spray-drying, the weight ratio of sodium bicarbonate incorporated before spray-drying to sodium silicate being within the range of from 0.20:1 to 0.45:1, preferably from 0.25:1 to 0.40:1.

Furthermore, according to a second aspect, there is provided a process which comprises forming an aqueous crutcher slurry and spray-drying it to a powder comprising:

(a) from 15 to 40% by weight, preferably from 20 to 40% by weight, of anionic surfactant;
(b) from 20 to 70% by weight of sodium carbonate;
(c) from 5 to 20% by weight of sodium silicate; and
(d) from 1 to 7.5% by weight of sodium bicarbonate, the weight ratio of sodium bicarbonate to sodium silicate being within the range of from 0.20:1 to 0.45:1, preferably from 0.25:1 to 0.40:1;

and then optionally admixing this spray-dried powder with up to 15% by weight, preferably 2.5 to 15% by weight, of additional sodium bicarbonate, all percentages being based on the final product.

The incorporation of a limited amount of sodium bicarbonate (1 to 7.5% by weight based on the final powder) in the slurry, in an amount related to the amount of silicate present, gives powders having improved physical properties. The powders can be spray-dried to relatively high moisture contents, for example, 8 to 20% by weight, without loss of particle strength; powders of lower moisture content, for example, 3 to 8%, are, however, also within the scope of the invention. The powders of the invention also exhibit improved bulk powder properties (flow, crispness) and improved appearance after storage in all types of environments.

The amount of bicarbonate that can be incorporated before spray-drying, that is to say, via the slurry, is limited to a maximum of 7.5% by weight based on the final powder, and the ratio of bicarbonate to silicate in the slurry must be within the range f from 0.20:1 to 0.45:1, preferably from 0.25:1 to 0.40:1. If more bicarbonate than this is present the slurry viscosity increases sharply to give a gel which is very difficult to handle; the properties of the powder formed by spray-drying are also inferior.

The bicarbonate which is included in the slurry may if desired be added in the form of sodium sesquicarbonate, $Na_2CO_3.NaHCO_3.2H_2O$. Additional carbonate will also be required since the amount of bicarbonate in the slurry (1 to 7.5% based on the final powder) is small compared with the amount of carbonate required (20 to 70% based on the final powder), and the sesquicarbonate cannot provide enough carbonate.

In addition to aiding processing, the presence of sodium bicarbonate in the powder helps to reduce the in-wash pH. Preferably the pH of a 4 g/l solution of the formulations of the invention is below 10.7, more preferably within the range of from 10.2 to 10.5. It is, however, not possible to include sufficient bicarbonate via the slurry in order to obtain this benefit, because of the processing problems previously mentioned. According to one preferred embodiment of the invention, therefore, further bicarbonate (up to 15% by weight, preferably 2.5 to 15% by weight, more preferably 3 to 10% by weight, based on the final powder) is admixed with (postdosed to) the spray-dried powder. The presence of postdosed bicarbonate gives further improvements in powder properties as well as reducing the in-wash pH.

In the compositions of the invention, the anionic surfactant may be selected from amongst any of the surfactant types commonly used in detergent compositions. Two such types are the alkali-metal alkylbenzene sulphonates, for example sodium linear or branched $C_{10}$–$C_{15}$ alkylbenzene sulphonate and the alkali-metal primary and secondary alkyl sulphates, for example sodium coconut alkyl sulphate and sodium tallow alcohol sulphate. The last two surfactants will be especially suitable choices in countries where there are plentiful supplies of natural oils. Other anionic surfactants which might be considered are alkali-metal alkane sulphonates, alkali metal olefin sulphonates and alkali metal primary and secondary alkyl ether sulphates. The last of these will be appropriate where an especially high foam profile is required of the product. All of these surfactants, or feedstocks from which they can be prepared by recognised sulphation/sulphonation techniques, are available commercially.

As has been said, the anionic surfactant should be present in an amount of from 15 to 40% by weight of the spray-dried composition, preferably from 20 to 35% by weight. Compositions containing lower levels of surfactant will be low in detergency and will not develop sufficient foam over the wash liquor, while compositions containing larger amounts of surfactant will not only be unnecessarily expensive but will produce soft creepy powders which will have poor flow characteristics and will cake too readily.

The detergency builder component of the formulation is an important feature of this invention. Carbonate species have the major advantage that they are at present very cheap in comparison with phosphates. Additionally they are much more acceptable politically, since they are not implicated in eutrophication. However, in conjunction with high levels of anionic surfactant there are problems with processing and in producing powders having satisfactory physical properties, and there is always a concern about pH levels. The present proposal to replace some of the carbonate by bicarbonate has been found to be successful in avoiding the processing problems and it improves the performance and physical properties of the powder, but, as explained previously, the amount of bicarbonate that can be included in the slurry is limited. As also mentioned previously, we have found that a further improvement in powder properties can be achieved by postdosing additional sodium bicarbonate, and this also gives the additional benefit of reduced in-wash pH.

Detergency builder compounds other than carbonate species, such as sodium citrate, sodium nitrilotriacetate, amorphous or crystalline sodium aluminosilicates, sodium orthophosphate, sodium pyrophosphate and sodium tripolyphosphate may also be present in the compositions of the invention, in amounts that preferably do not exceed 10% by weight.

Sodium silicate is an essential component of the compositions and should be present in an amount of from 5 to 20% by weight. It contributes to the alkalinity of the compositions and assists with particle structuring during spray-drying, as well as being a powerful corrosion inhibitor. Sodium alkaline silicate, having a silicate ($SiO_2$:$Na_2O$) ratio of less than 3, is preferred for use in the present invention.

The storage stability of compositions in accordance with the invention can be further improved by addition of clays to the slurry prior to spray-drying. A preferred clay is kaolin, but other clays such as talc and bentonite are also effective. Clays may be present in amounts of from 2 to 15% by weight.

The compositions of the invention may also contain a number of other optional components such as foam boosters, for example, alkanolamides; anti-redeposition agents such as sodium carboxymethyl cellulose; fabric softening agents such as quaternary ammonium salts either alone or in combination with smectite-type clays; anti-ashing aids; starches; slurry stabilisers such as copolymers of ethylene and maleic anhydride, usually in salt form; antioxidants; fluorescers; and enzymes.

Oxygen bleaches such as sodium perborate may also be used if desired, as may reducing bleaches such as sodium sulphite, and photobleaches.

The formulations and processes of the invention will be further illustrated in the following non-limiting Examples.

EXAMPLE 1

A detergent powder (Composition 1) in accordance with the invention was prepared by spray-drying and compared with a control powder (Comparative Composition A) of similar formulation which differed in that the 4% content of sodium bicarbonate in Composition 1 was replaced by sodium carbonate, and in that the moisture content was slightly lower. A second control formulation (Comparative Composition B) had a higher level (10%) of sodium bicarbonate: its slurry was viscous and difficult to handle.

The full formulations were as follows:

| | % by weight | | |
|---|---|---|---|
| | 1 | A | B |
| Sodium linear alkylbenzene sulphonate | 28.0 | 28.0 | 28.0 |
| Sodium carbonate | 41.0 | 45.0 | 35.0 |
| Sodium alkaline silicate | 12.0 | 12.0 | 12.0 |
| Sodium bicarbonate | 4.0 | — | 10.0 |
| Sodium sulphate | 6.0 | 8.0 | 8.0 |
| Sodium carboxymethyl cellulose | 0.6 | 0.6 | 0.6 |
| Fluorescer | 0.2 | 0.2 | 0.2 |
| Perfume | 0.1 | 0.1 | 0.1 |
| Colourant | 0.1 | 0.1 | 0.1 |
| Moisture | 8.0 | 6.0 | 6.0 |
| | 100.0 | 100.0 | 100.0 |
| Ratio bicarbonate:silicate | 0.33 | — | 0.83 |

Four physical measurements of the powders were then made by methods known to those skilled in the art of detergent powder manufacture. The results are shown below:

| | 1 | A | B |
|---|---|---|---|
| Particuate strength ($Nm^{-2} \times 10^4$) | 20 | 10 | 5 |
| Powder flow rate (mls/sec) | 100 | 85 | 50 |
| Cohesion Test value (Kg) | 2.5 | 4.0 | 5.0 |
| In-pack powder caking (%) during storage (6 weeks, 28° C., 70% RH) | 30 | 80 | 50 |

From these figures it can be seen that particulate strength and flow rate were increased, and cohesiveness and caking reduced, by incorporation of a controlled amount of sodium bicarbonate into the formulation. Too high a level of sodium bicarbonate causes these properties to deteriorate again.

EXAMPLES 2 & 3

Three further detergent powders were prepared, two (Compositions 2 and 3) being in accordance with the invention and the other (Comparative Composition C) being a control powder. Composition 2, which contained 10% by weight of sodium bicarbonate, was made by postdosing of 6% by weight of this bicarbonate to a powder prepared by spray-drying an aqueous detergent slurry containing the remaining bicarbonate (4%). Composition 3 and Comparative Composition C were prepared by a straightforward spray-drying operation: Composition 3 contained 4% by weight of sodium bicarbonate incorporated via the slurry. The full formulation of the powders was as follows:

| | % by weight | | |
|---|---|---|---|
| | 2 | 3 | C |
| Sodium linear alkylbenzene sulphonate | 24.0 | 24.0 | 24.0 |
| Sodium alkaline silicate | 11.0 | 11.0 | 11.0 |
| Sodium carbonate | 35.0 | 35.0 | 45.0 |
| Sodium bicarbonate (via slurry) | 4.0 | 4.0 | — |
| Sodium sulphate | 11.1 | 16.6 | 13.1 |
| Sodium carboxymethyl cellulose | 0.5 | 0.5 | 0.5 |
| Fluorescer | 0.2 | 0.2 | 0.2 |
| Perfume | 0.2 | 0.2 | 0.2 |
| Moisture | 8.0 | 8.5 | 6.0 |
| Sodium bicarbonate (postdosed) | 6.0 | — | — |
| | 100.0 | 100.0 | 100.0 |
| Ratio of bicarbonate (in slurry) to silicate | 0.36 | 0.36 | — |

The physical properties of these powders were as follows:

| | 2 | 3 | C |
|---|---|---|---|
| Particulate strength ($Nm^{-2} \times 10^4$) | 25 | 25 | 10 |
| Powder flow rate (mls/sec) | 100 | 100 | 85 |
| Cohesion test value (Kg) | 1.75 | 2.0 | 3.0 |
| In-pack powder caking (%) during storage (6 weeks, 28° C., 70% RH) | 20 | 20 | 70 |

These powders were also used to wash clothing in a hand wash procedure, and the wash solution was scored by a panel of skilled assessors on a varying point scale for the two attributes of "lather volume" and "kindness to hands". The results were as follows:

| | Average Score | | |
|---|---|---|---|
| | 2 | 3 | C |
| Lather volume (Scale 1-5) | 4.47 | 4.28 | 4.24 |
| Kindness to hands (Scale 1-5) | 3.67 | 3.31 | 3.21 |
| Overall (Scale 1-7) | 4.97 | 4.56 | 4.53 |

It can be seen that as well as receiving a higher overall score, the powder formulation according to the invention was preferred on both of the attributes tested.

The pH's of 4 g/l solutions of Compositions 2 and C in water of 30° French hardness were 10.4 and 11.0 respectively.

EXAMPLE 4

Two powders containing a higher level (35% by weight) of anionic surfactant were prepared by spray-drying. Composition 4 in accordance with the invention contained 5.5% by weight of sodium bicarbonate, all incorporated via the slurry, while Comparative Composition D was a control containing no bicarbonate.

| | % by weight | |
|---|---|---|
| | 4 | D |
| Sodium linear alkylbenzene sulphonate | 35.0 | 35.0 |
| Sodium carbonate | 35.5 | 43.0 |
| Sodium alkaline silicate | 15.0 | 15.0 |
| Sodium bicarbonate | 5.5 | — |
| Sodium sulphate | 2.0 | 2.0 |
| Sodium carboxymethyl cellulose | 0.6 | 0.6 |
| Fluorescer | 0.2 | 0.2 |
| Perfume | 0.2 | 0.2 |
| Moisture | 6.0 | 4.0 |
| | 100.0 | 100.0 |
| Ratio of bicarbonate to silicate | 0.37 | — |

The physical properties of these powders were as follows:

| | 4 | D |
|---|---|---|
| Particulate strength ($Nm^{-2} \times 10^4$) | 10 | 5 |
| Powder flow rate (mls/sec) | 90 | 85 |
| Cohesion test value (Kg) | 3.5 | 6.0 |
| In-pack powder caking (%) during storage (6 weeks, 28° C., 70% RH) | 60 | 100 |

EXAMPLE 5

Two powders containing higher levels of sodium carbonate and relatively low levels of silicate were prepared by spray-drying. Composition 5 in accordance with the invention contained 3.5% by weight of sodium bicarbonate, all incorporated via the slurry, while Comparative Composition E was a control containing no bicarbonate.

| | % by weight | |
|---|---|---|
| | 5 | E |
| Sodium linear alkylbenzene sulphonate | 24.0 | 24.0 |
| Sodium carbonate | 51.6 | 55.1 |
| Sodium alkaline silicate | 10.0 | 10.0 |
| Sodium bicarbonate | 3.5 | — |
| Sodium sulphate | 2.0 | 2.0 |
| Sodium carboxymethyl cellulose | 0.5 | 0.5 |
| Fluorescer | 0.2 | 0.2 |
| Perfume | 0.2 | 0.2 |
| Moisture | 8.0 | 8.0 |
| | 100.0 | 100.0 |
| Ratio of bicarbonate to silicate | 0.35 | — |

The physical properties of these powders were as follows:

| | 5 | E |
|---|---|---|
| Particulate strength ($Nm^{-2} \times 10^4$) | 35 | 15 |
| Powder flow rate (mls/sec) | 100 | 85 |
| Cohesion test value (Kg) | 2.0 | 3.5 |
| In-pack powder caking (%) during storage | 20 | 75 |

-continued

| | 5 | E |
|---|---|---|
| (6 weeks, 28° C., 70% RH) | | |

EXAMPLE 6

A powder similar to Composition 1 but also containing 8% by weight f kaolin, incorporated via the slurry, was prepared by spray-drying. The compositions and properties of Composition 1 are repeated here for convenience.

| | % by weight | |
|---|---|---|
| | 6 | 1 |
| Sodium linear alkylbenzene sulphonate | 28.0 | 28.0 |
| Sodium carbonate | 35.0 | 41.0 |
| Sodium alkaline silicate | 12.0 | 12.0 |
| Sodium bicarbonate | 4.0 | 4.0 |
| Sodium sulphate | 2.0 | 6.0 |
| Sodium carboxymethyl cellulose | 0.6 | 0.6 |
| Kaolin | 8.0 | — |
| Fluorescer | 0.2 | 0.2 |
| Perfume | 0.2 | 0.2 |
| Moisture | 10.0 | 8.0 |
| | 100.0 | 100.0 |
| Ratio of bicarbonate to silicate | 0.33 | 0.33 |

The physical properties of these powders were as follows:

| | 6 | 1 |
|---|---|---|
| Particulate strength ($Nm^{-2} \times 10^4$) | 20 | 20 |
| Powder flow rate (mls/sec) | 110 | 100 |
| Cohesion test value (Kg) | 2.3 | 2.5 |
| In-pack powder caking (%) during storage (6 weeks, 28° C., 70% RH) | 10–15 | 30 |

It will be seen that the incorporation of kaolin resulted in a further significant improvement with respect to caking.

EXAMPLE 7

Three powders were prepared by spray-drying to show th effect of varying the silicate level at constant bicarbonate level. Composition 7 in accordance with the invention contained 20% of sodium silicate and 7.5% by weight of sodium bicarbonate (ratio 0.38); Comparative Composition G contained the same amount of sodium bicarbonate but only 5.0% of sodium silicate (ratio 1.5); and Comparative Composition H was similar to G but contained no sodium bicarbonate.

| | % by weight | | |
|---|---|---|---|
| | 7 | G | H |
| Sodium linear alkylbenzene sulphonate | 25.0 | 25.0 | 25.0 |
| Sodium carbonate | 34.5 | 53.5 | 53.5 |
| Sodium alkaline silicate | 20.0 | 5.0 | 5.0 |
| Sodium bicarbonate | 7.5 | 7.5 | — |
| Sodium sulphate | 2.0 | 2.0 | 9.5 |
| Sodium carboxymethyl cellulose | 0.6 | 0.6 | 0.6 |

-continued

| | % by weight | | |
|---|---|---|---|
| | 7 | G | H |
| Fluorescer | 0.2 | 0.2 | 0.2 |
| Perfume | 0.2 | 0.2 | 0.2 |
| Moisture | 10.0 | 6.0 | 6.0 |
| | 100.0 | 100.0 | 100.0 |
| Ratio bicarbonate:silicate | 0.38 | 1.50 | — |

The physical properties of these powders were as follows:

| | 7 | G | H |
|---|---|---|---|
| Particulate strength ($Nm^{-2} \times 10^4$) | 48 | 5 | 7 |
| Powder flow rate (mls/sec) | 110 | Nil | 70 |
| Cohesion test value (Kg) | 0.8 | 5.0 | 4.0 |
| In-pack powder caking (%) during storage (6 weeks, 28° C., 70% RH) | 35 | 50 | 60 |

It will be seen that the improvement according to the invention was not obtained when the bicarbonate to silicate ratio was too high (Comparative Composition G). Indeed, the flow rate was considerably worse than that of the similar powder (Comparative Composition H) containing no sodium bicarbonate.

What is claimed is:

1. A process for the preparation of a spray-dried detergent powder, which comprises forming an aqueous crutcher slurry and spray-drying it to a powder comprising:

(a) from 15 to 40% by weight of anionicsurfactant;

(b) from 20 to 70% by weight of sodium carbonate;

(c) from 5 to 20% by weight of sodium silicate;

(d) from 1 to 7.5% by weight of sodium bicarbonate;

the weight ratio of sodium bicarbonate to sodium silicate being within the range of from 0.25:1 to 0.40:1, all percentages being based on the final product.

2. A process as claimed in claim 1, wherein from 2.5 to 15% by weight of additional sodium bicarbonate is admixed with the spray-dried powder.

3. A process as claimed in claim 1, wherein from 3 to 10% by weight of additional sodium bicarbonate is admixed with the spray-dried powder.

4. A process as claimed in claim 1, wherein the powder contains from 20 to 35% by weight of anionic surfactant.

5. A process as claimed in claim 1, wherein the powder contains from 25 to 60% by weight of sodium carbonate.

6. A process as claimed in claim 1, wherein there is added to the slurry a clay in an amount of from 2 to 15% by weight, based on the final product.

7. A spray-dried detergent powder comprising (a) from 15 to 40% by weight of anionic surfactant, (b) from 20 to 70% by weight of sodium carbonate, (c) from 5 to 20% by weight of sodium silicate, and (d) from 1 to 7.5% by weight of sodium bicarbonate, the weight ratio of sodium bicarbonate to sodium silicate being within the range of from 0.25:1 to 0.40:1.

8. A spray-dried detergent powder comprising (a) from 15 to 40% by weight of anionic surfactant, (b) from 20 to 70% by weight of sodium carbonate, (c) from 5 to 20% by weight of sodium silicate, and (d) from 1 to 22.5% by weight of sodium bicarbonate, of which from 1 to 7.5% by weight is incorporated before spray-drying and from 0 to 15% by weight admixed after spray-drying, the weight ratio of sodium bicarbonate incorporated before spray-drying to sodium silicate being within the range of from 0.25:1 to 0.40:1.

9. A detergent powder as claimed in claim 8, of which the pH of a 4 g/liter solution in water of 30° French hardness is within the range of from 10.2 to 10.5.

10. A spray-dried detergent powder conprising (a) from 15 to 40% by weight of anionic surfactant,
(b) from 20 to 70% by weight of sodium carbonate,
(c) from 5 to 20% by weight of sodium silicate, and
(d) from 3.5 to 22.5% by weight of sodium bicarbonate, of which from 1 to 7.5% by weight is incorporated before spray-drying and from 2.5 to 15% by weight admixed after spray-drying, the weight ratio of sodium bicarbonate incorporated before spray-drying to sodium silicate being within the range of from 0.20:1 to 0.45:1.

* * * * *